US006739965B2

(12) United States Patent
String

(10) Patent No.: US 6,739,965 B2
(45) Date of Patent: May 25, 2004

(54) HIGH SPEED, HIGH VOLUME COIN SORTER

(76) Inventor: Floyd K. String, 2360 Forest Hill Dr., Harrisburg, PA (US) 17112

( * ) Notice: Subject to any disclaimer, the term of this patent is extended or adjusted under 35 U.S.C. 154(b) by 197 days.

(21) Appl. No.: 10/145,359

(22) Filed: May 14, 2002

(65) Prior Publication Data

US 2003/0216118 A1 Nov. 20, 2003

(51) Int. Cl.[7] ..... G07D 3/02

(52) U.S. Cl. ..... 453/5; 209/680; 209/684; 209/917

(58) Field of Search ..... 453/5, 7, 11; 209/509, 209/606, 617, 620, 621, 622, 651, 659, 680, 684, 917; 198/560, 603

(56) References Cited

U.S. PATENT DOCUMENTS

| | | | | | |
|---|---|---|---|---|---|
| 802,550 | A | | 10/1905 | Batdorf et al. | |
| 1,038,293 | A | * | 9/1912 | Osterbrock et al. | 453/11 |
| 1,512,447 | A | | 10/1924 | Birdsall | |
| 1,553,979 | A | * | 9/1925 | Frederick | 453/11 |
| 1,934,839 | A | | 11/1933 | Bock et al. | 133/3 |
| 2,101,513 | A | | 12/1937 | Samuelsen et al. | 133/3 |
| 2,799,384 | A | * | 7/1957 | Rutherford | 198/560 |
| 3,621,854 | A | | 11/1971 | Redman | 133/3 H |
| 3,726,290 | A | | 4/1973 | Zimmerman | 133/3 R |
| 3,771,538 | A | | 11/1973 | Reis | 133/3 D |
| 3,788,440 | A | | 1/1974 | Propice et al. | 194/99 |
| 3,818,918 | A | | 6/1974 | Nissmo et al. | 133/3 H |
| 4,226,254 | A | | 10/1980 | Mouri et al. | 133/8 E |
| 4,832,654 | A | * | 5/1989 | Stoeckli | 453/7 |
| 4,881,918 | A | | 11/1989 | Goh et al. | 453/4 |
| 5,000,718 | A | | 3/1991 | Abe | 453/57 |
| 5,135,433 | A | * | 8/1992 | Watanabe et al. | 453/3 |
| 5,207,611 | A | | 5/1993 | Ueda et al. | 453/11 |
| 5,230,653 | A | | 7/1993 | Shinozaki et al. | 453/4 |
| 5,295,899 | A | | 3/1994 | Adams et al. | 453/10 |
| 5,355,988 | A | | 10/1994 | Shirasawa | 194/217 |
| 5,382,191 | A | | 1/1995 | Rasmussen | 453/11 |
| 5,425,669 | A | | 6/1995 | Geib et al. | 453/10 |
| 5,474,495 | A | | 12/1995 | Geib et al. | 453/3 |
| 5,489,237 | A | | 2/1996 | Geib et al. | 453/12 |
| 5,501,631 | A | | 3/1996 | Mennie et al. | 453/3 |
| 5,525,104 | A | | 6/1996 | Adams et al. | 453/10 |
| 5,551,911 | A | | 9/1996 | Rumbach | 453/3 |
| 5,722,882 | A | | 3/1998 | Kashiwagi et al. | 453/11 |
| 6,053,807 | A1 | | 4/2001 | Metzger et al. | 453/57 |

* cited by examiner

*Primary Examiner*—Donald P. Walsh
*Assistant Examiner*—Mark J Beauchaine
(74) *Attorney, Agent, or Firm*—Hooker & Habib, P.C.

(57) ABSTRACT

A high-speed, high-volume coin sorter includes a coin feed device and a coin sorting device. The coin sorting device includes a number of stationary sorting plates, each plate associated with a respective coin denomination. Coins are successively driven along each sorting plate, with coins associated with the sorting plate discharged at the end of the plate. The other coins drop through the plate and fall onto a conveyor to be transferred to the next sorting plate.

28 Claims, 9 Drawing Sheets

HIGH SPEED, HIGH VOLUME COIN SORTER

FIELD OF THE INVENTION

The invention relates to sorting coins or other items by the diameter of the coin or item.

BACKGROUND OF THE INVENTION

There is a need to sort ever-increasing volumes of coins at ever-higher speeds.

A known high-volume coin sorter employs a number of sorting plates. Each plate is associated with a different denomination of coin and includes a number of through-holes extending through the thickness of the plate. The diameter of the holes is slightly smaller than the diameter of the coin associated with the plate. The plates are stacked vertically above one another, with each higher plate associated with the next larger diameter coin.

Unsorted coins are placed on the uppermost sorting plate. The plate is shaken to "skitter" or displace the coins. Coins having a diameter larger than the hole diameter remain on the plate. Coins having a smaller diameter fall through the plate and drop onto the next lower plate. All the plates shake simultaneously to drop smaller coins on lower plates. Eventually each plate holds only the coins associated with the plate.

This known coin sorter has a number of disadvantages. Shaking the coins limits sorting speed. The sorter generates high levels of noise and vibration. Keeping noise and vibration within tolerable limits further slows sorting speed.

Other known coin sorters use a rotating disk to discharge coins to a sorting rail or sorting plate. The coins are discharged one-by-one from the disk, limiting sorting speed.

Thus, there is a need for an improved coin sorter. The improved coin sorter should sort a high volume of coins at high speed, without excessive noise or vibration.

SUMMARY OF THE INVENTION

The invention is directed to an improved high-speed, high-volume coin sorter. The improved coin sorter sorts a large volume of coins more rapidly than conventional sorters, without excessive noise or vibration.

A coin sorter in accordance with the present invention includes a coin feed device and a coin sorting device. The feed device is configured to receive unsorted coins of various denominations and feed the coins to the coin sorting device for sorting. The coin sorting device has a number of stationary sorting stations that separate the flow of coins into sorted sets of coins.

The sorting stations can be formed as stationary sorting plates, each sorting plate associated with a respective coin denomination. Each sorting plate has holes that are sized to prevent coins of a first set of coin denominations from falling through the holes, but allow a second set of coin denominations to fall through. The sorting plates are arranged in series to progressively sort the coins.

In a preferred embodiment each sorting plate includes a surface for supporting coins on the plate, an intake end for receiving coins onto the plate, a discharge end downstream of the intake end for discharging coins from the plate, and a number of through-holes between the ends of the plate. Each hole extends from the surface through the thickness of the plate and has a diameter smaller than the coin diameter of the denomination associated with the sorting plate, but larger than the next-smaller.

The coin sorter further includes a number of drive devices and one or more transfer devices. Each drive device is associated with a respective sorting plate to drive coins downstream along the top surface of the plate. The drive device presses the coins against the surface of the plate while urging the coins along the plate. Coins having a diameter less than the diameter of the plate holes drop into the holes and fall through the plate. The remaining coins are driven to the discharge end of the plate. Each transfer device is disposed beneath a respective preceding sorting plate to receive coins that fall through the plate and transfer the coins to the succeeding plate.

In operation, a stream of unsorted coins are fed by the feed device to the sorting plate associated with the largest-diameter coin. The coins are driven along the sorting plate. Coins of the denomination associated with the sorting plate are driven the entire length of the sorting plate and discharged from the end of the plate. Smaller diameter coins fall through the holes in the sorting plate and are transported to the succeeding plate. The process successively repeats, with each coin denomination sequentially removed from the stream and discharged from a sorting plate and the remaining smaller diameter coins transferred to the succeeding sorting plate.

In preferred embodiments of the present invention the coin sorting device includes a number of conveyors that form portions of the transfer devices. Each conveyor is located beneath a respective preceding sorting plate to receive the coins that drop through the plate and transport them to the succeeding plate. In yet other possible embodiments the conveyors are endless conveyors that also form portions of the drive devices. The endless conveyors engage and drive the coins along the sorting plates.

In particularly advantageous embodiments of the present invention the driving devices incline the sorting plates at an angle with respect to the horizontal. This reduces the power required to operate the sorter. Gravity assists in urging the coins along the sorting plates. The coins could slide down the plates by gravity alone or in conjunction with the conveyor belts.

The stationary sorting plates substantially reduce noise and vibration in comparison to high-volume sorters having moving sorting plates. The stationary plates can be large enough to support a large number of coins. The plates can be vertically stacked so that the coin sorter is compact and takes up a relatively little floor space.

Other objects and features of the invention will become apparent as the description proceeds, especially when taken in conjunction with the accompanying drawings illustrating the invention, of which there are nine sheets of drawings and four embodiments.

DESCRIPTION OF THE PREFERRED EMBODIMENTS

Figure 1:
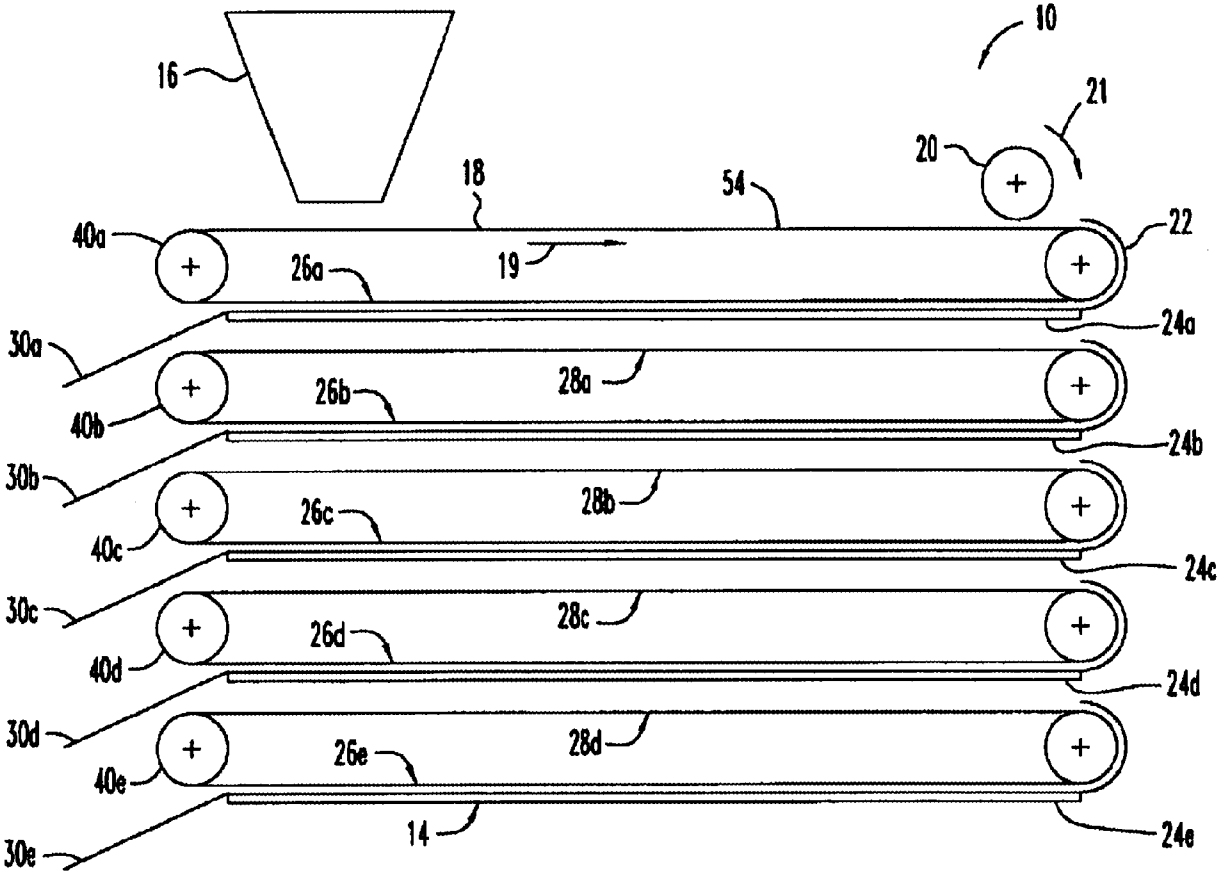
FIG. 1 is a front schematic view of a first embodiment coin sorter in accordance with the present invention.

FIG. 1 illustrates a first embodiment coin sorter 10 made in accordance with the present invention. The coin sorter includes a coin feed device 12 located above a coin sorting device 14.

The coin feed device includes an intake hopper 16 spaced above a conveyor 18. The conveyor 18 receives unsorted coins from the hopper and carries the coins downstream in the direction indicated by the arrow 19 to the sorting device 14. A stripper wheel 20 is located above the conveyor belt 18 downstream of the hopper. The stripper wheel spans the entire width of the conveyor. The stripper wheel 20 and the conveyor belt 18 define a gap having a height less than twice the minimum coin thickness. The stripper wheel, preferably formed as a wire brush, rotates in the direction indicated by the arrow 21 to strip away coins stacked on other coins and form a single layer of coins on the conveyor belt 18. The operation of the stripper wheel 20 is conventional and so will not be described in further detail. After exiting from beneath the stripper wheel, the single layer of coins is guided by a guide wall 22 and discharged to the coin sorting device 14 beneath the conveyor.

The coin sorting device 14 has a number of stationary, sorting stations formed as horizontal coin sorting plates 24. Each sorting plate 24*a*–24*e* is associated with a respective coin denomination as will be described below. Located above each sorting plate 24 is a drive device 26. Each drive device 26*a*–26*e* is associated with a respective sorting plate 24*a*–24*e* to drive coins along the sorting plate. Below each sorting plate 24 (except the lowest plate 24*e*) is a transfer device 28. Each transfer device 28*a*–28*d* is associated with a respective sorting plate 28*a*–28*d* to receive coins that fall through the plate and transfer them to the succeeding plate. At the end of each sorting plate 24 a chute 30 receives coins discharged from the end of the plate for counting, wrapping, bagging or other processing.

Each sorting plate is associated with a respective coin denomination and discharges that denomination coin to the chute. The illustrated coin sorter 10 is intended for sorting U.S. denomination coins. One sorting plate is associated with half dollar coins, another sorting plate is associated with quarters, and so on, with the last sorting plate associated with dimes (the smallest diameter coin denomination in U.S. currency). In other embodiments, a sorting plate can be associated with two or more denominations of coins. For example, if the half-dollar plate were eliminated from the apparatus 10, the quarter plate would discharge half-dollars and quarters. Such plates are deemed associated with one specific denomination although multiple denominations of coins are intended to be discharged from the plate.

Each sorting plate 24 but the plate associated with the smallest-diameter coin represents a preceding plate with respect to a succeeding plate. The succeeding plate is the plate associated with the next-smaller-diameter coin denomination. For example, the pair of plates associated with quarters and nickels represent a preceding plate (the quarters plate) with respect to its succeeding plate (the nickels plate). Similarly, the nickels plate is a preceding plate with respect to its succeeding plate, the pennies plate. Each transfer device 28 is associated with a respective preceding plate to receive coins that fall through the plate and transfer them to the succeeding plate.

Figure 2:
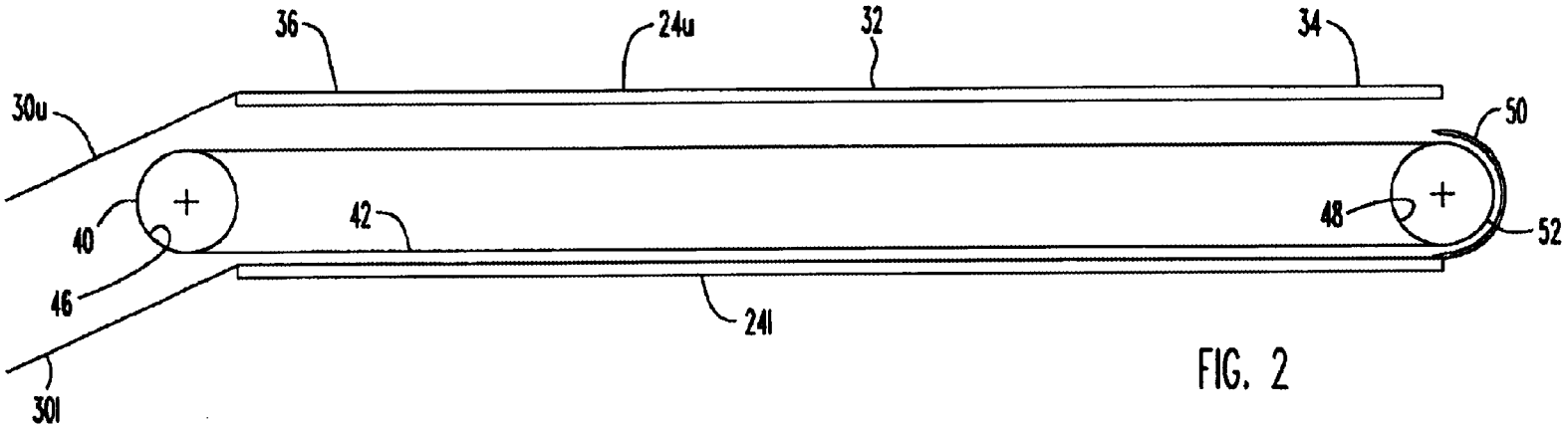
FIG. 2 is an enlarged view of a portion of the coin sorter shown in FIG. 1.

The sorting plates 24 overlie each other, with each preceding plate spaced above and overlying its succeeding plate. In the illustrated embodiment the respective pairs of preceding and succeeding sorting plates are vertically aligned with each other and thereby form respective pairs of upper and lower sorting plates 24*u* and 24*l*. See FIG. 2. The uppermost plate 24*a* is associated with half dollar coins, and each vertically lower sorting plate 24*b*–24*e* is associated with the next-smaller-diameter coin.

Each sorting plate includes an upper surface 32 that extends downstream from an intake end 34 to a discharge end 36 adjacent the discharge chute 30. Through-holes 38 extend from the support surface 32 through the thickness of the plate. Each through-hole 38 has a diameter slightly smaller than the diameter of the coin denomination associated with the sorting plate. The sorting plates are intended to support a large number of coins, and each plate is formed from a steel plate approximately eight feet long, four feet wide and an eighth of an inch thick.

Portions of the transfer device 28 associated with the upper plate 24*u* and the drive device 26 associated with the lower plate 24*l* are each formed on a conveyor belt 40. The conveyor belt 40 includes a lower belt run 42 and an upper belt run 44 that travel between conveyor rollers 46, 48. The lower belt run 42 forms a portion of the drive device 26 associated with the lower sorting plate 24*l*. The lower belt run engages the coins, presses the coins against the surface of the plate 24*l*, and drives the coins downstream from the plate's intake end to the plate's discharge end. The upper belt run 44 forms a portion of the transfer device 28 associated with the upper sorting plate 24*l*. The upper belt run receives coins that fall through the upper sorting plate 24*u* and conveys them to the intake end of the lower sorting plate 24*l*.

A guide wall 50 extends partially around the pulley 48 and cooperates with the conveyor belt to define a coin channel 52. The channel 52 receives coins from the upper belt run, directs the coins around the pulley, and discharges them to the inlet end of the lower sorting plate 24*l*. The dimensions of the channel 52 are not critical but must provide sufficient clearance for coins to pass around the roller 48 without jamming. For example, a radial clearance of about ½ inch to ¾ inch has been found satisfactory for U.S. coins.

The guide wall 50 can be formed from commercially available PVC pipe or equivalent cut along the length of the pipe and attached to the intake end of the sorting plate. The guide wall can be attached to the sorting plate with flat-head screws recessed below the inner surface of the pipe. Preferably the exposed ends of the pipe are beveled or tapered as shown to provide a smooth transition into and out of the channel 52.

The coin sorter 10 includes a number of the conveyor belts 40, each conveyor belt 40*b*–40*e* disposed between respective pairs of upper and lower sorting plates 24*a*–24*b*, 24*b*–24*c* and so on (see FIG. 1). The conveyor belts 40*b*–40*e* form portions of the drive device 26 and the transfer device 28 between respective upper and lower sorting plates as described above.

The uppermost conveyor belt 40*a* is located above the uppermost sorting plate 24*a*. The lower belt run of the conveyor belt 40*a* forms a portion of the drive device 26 associated with the plate 24*a*. The upper belt run 54 of the uppermost conveyor belt 40*a* is located below the hopper 16 and forms the conveyor 18. The upper belt run 54 and the guide wall 22 feed coins to the intake end of the uppermost sorting plate 24*a* in essentially the same way that the transfer devices 28 feed coins to the intake ends of the plates 24*b*–24*e*.

Figure 3:
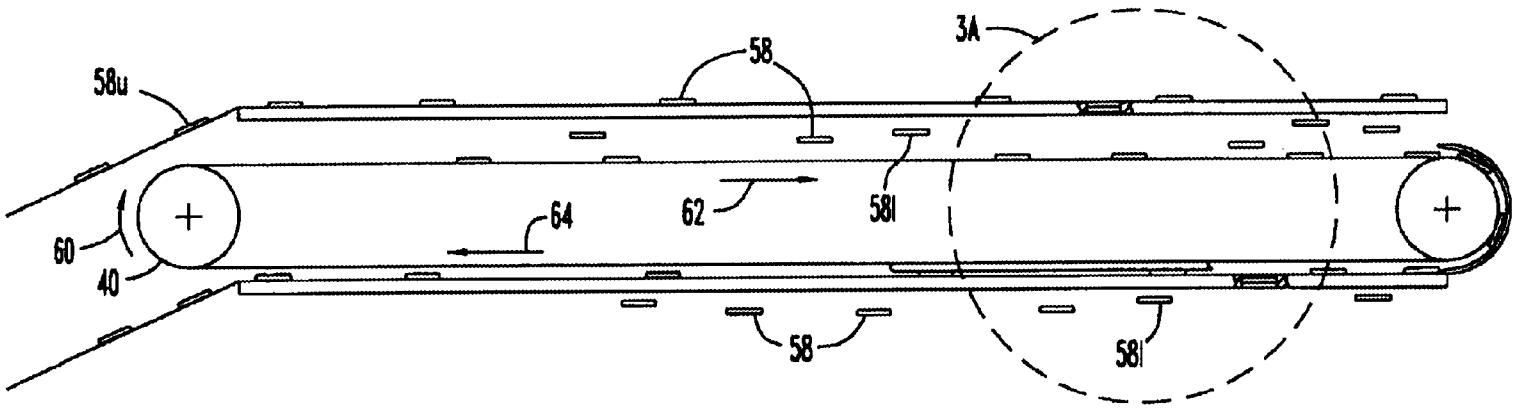
FIG. 3 is similar to FIG. 2 but showing operation of the coin sorter.
Figure 3A:
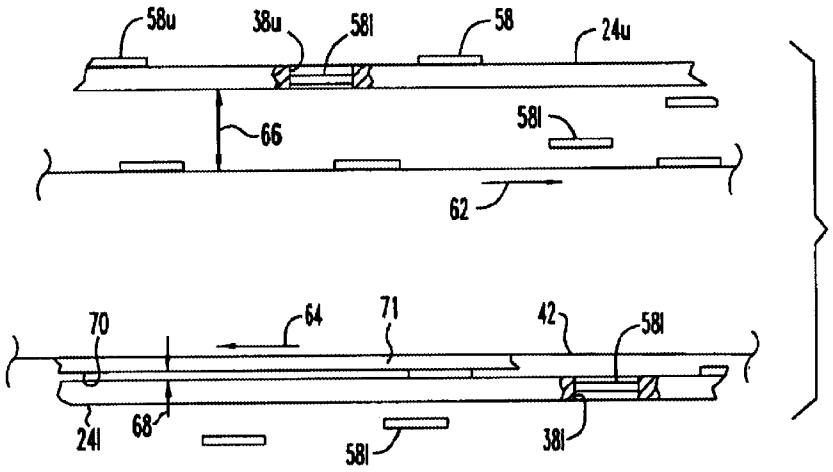
FIG. 3A is a closer view of the area indicated by detail circle 3A shown in FIG. 3.

FIGS. 3 and 3A illustrate the sorting and transfer of coins 58 between pairs of upper and lower sorting plates 24*u*, 24*l*. For clarity the coins are drawn larger than scale, it being understood the coins are of various denominations. The conveyor belt 40 is driven in the direction of rotation 60, the upper belt traveling in an upper belt direction 62 and the lower belt traveling in the opposite lower belt direction 64. The spacing between the upper sorting plate 24*u* and the upper belt run 44 is preferably less than the smallest diameter coin so that coins cannot stand on edge on belt 44 after falling through the upper sorting plate 24*l*. The spacing 68 between the lower belt outer surface 70 and the lower plate 24*l* is preferably less than the minimum thickness of the coins driven across the plate. A portion 71 representing the conveyor belt thickness is shown in FIGS. 3 and 3A illustrates the belt engaging the coins.

The spacing 68 ensures that the lower belt run engages all the coins and drives them along the plate. The conveyor belt can be made of carpet or piled or napped fabric to engage adjacent coins of differing thickness. Alternative conveyor belt constructions intended to engage and drive coins of differing thickness across plates are known and so will not be described in further detail.

Coins 58 are driven along the upper surface of the upper plate 24*u* from the intake end of the plate towards the discharge end of the plate. The coins are driven by the lower belt run (not shown in FIGS. 3 and 3A) of the conveyor belt located above the upper plate 24*u*. Coins 58*u* whose diameters are larger than the diameter of the holes 38*u* in the upper sorting plate slide the entire length of the plate and discharge from the discharge chute 30*u*. The remaining coins 58*l*, whose diameters are less than the diameter of the holes 38*u*, fall through the holes. In this way the coins are selectively sorted, with coins of the denomination associated with the sorting plate discharged at the end of the sorting plate and the remaining smaller-diameter coins sorted at succeeding sorting plates.

The smaller diameter coins 58*l* drop onto the upper belt run 44 of the conveyor belt 40 located between the upper and lower plates, pass through the coin channel 52, and are discharged to the intake end of the lower sorting plate 24*l*. The lower belt run 42 drives the coins along the lower plate 24*l* to repeat the sorting process. If the lower plate is associated with the smallest diameter coin (for example, dimes) the sorting plate is used to remove contamination from the dimes before the dimes are discharged.

Figure 4:
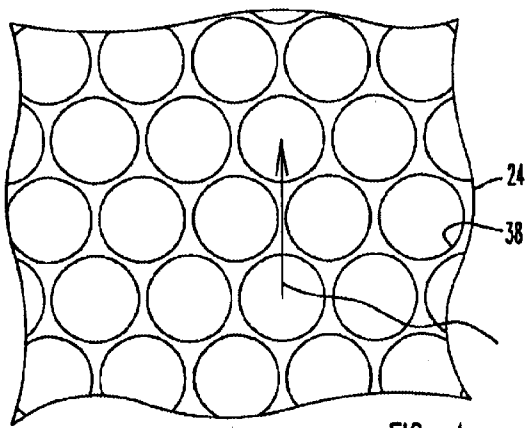
FIG. 4 is a partial top view of a first embodiment sorting plate used in the coin sorter shown in FIG. 1.

FIG. 4 illustrates the upper surface of the sorting plate 24. The coin holes 38 are aligned in columns parallel with the lower belt direction 64. It has been found that occasionally smaller diameter coins will not fall through the holes 38 and are found at the discharge chute 30. It is believed that some coins may not fully overly the holes as they slide down the plate and therefore do not fall through the holes.

Figure 5:
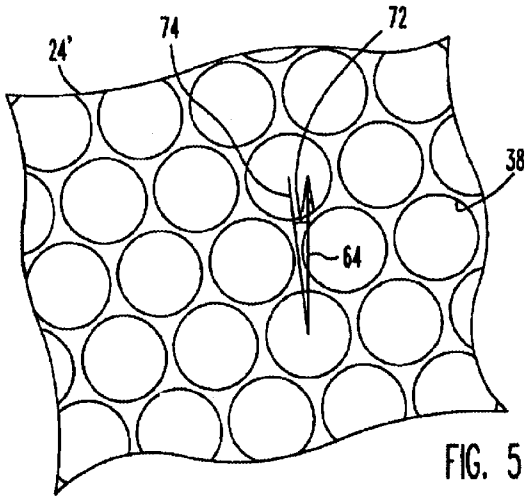
FIG. 5 is a view similar to FIG. 4 of a second embodiment sorting plate used in the coin sorter shown in FIG. 1.

FIG. 5 illustrates a preferred embodiment sorting plate 24 in which the sorting holes 38 are aligned in straight columns offset by an angle 72 from the drive axis 64. The columns extend along an offset longitudinal axis 74. It has been found that orienting the holes along the offset axis 74 reliably ensures that smaller diameter coins will eventually overlie a hole and fall through the plate prior to reaching the discharge end of the plate. The angle 72 is preferably about 5 degrees, and can be achieved by mounting the plate 24 at the desired offset angle 72 with respect to the lower belt run 42.

Operation of the coin sorter 10 will now be described. Unsorted coins are dumped into the hopper 16 and transported to the intake end of the uppermost sorting plate 24*a* via the belt run 54 and the guide wall 22. The coins pass beneath the spitter wheel 20 as previously described before reaching the guide wall. If desired, the belt run 54 can be configured to run uphill to the spitter wheel 20 so that gravity assists the spitter wheel in urging stacked coins back towards the hopper.

The feed device 12 discharges the coins at the intake end of the sorting plate 24*a*. The coins are driven along the sorting plate 24*a*, with half-dollar and larger diameter coins being discharged from the chute 30*a*. Quarters, nickels, pennies and dimes fall through the uppermost sorting plate 24*a* and are transported to the intake end of the succeeding plate 24*b*. These coins are driven along the sorting plate 24*b*, with quarters being discharged from the chute 30*b* and smaller-diameter coins transported to the intake end of the next succeeding sorting plate 24*c*. The process successively repeats, with each coin denomination sequentially removed and discharged from a sorting plate and the remaining unsorted coins transferred to the succeeding sorting plate.

In the illustrated embodiment the sorting plate 24*e* is associated with dimes, the smallest diameter U.S. coin denomination. The sorting plate 24*e* removes contamination from the stream of dimes before the dimes are discharged to chute 30*e*. If it is known that the coins supplied to the sorting device 14 are free from contamination, the sorting plate 24*e* can be omitted and the dimes that fall through the pennies plate 24*d* can be discharged directly from the sorting device 14.

Figure 6:
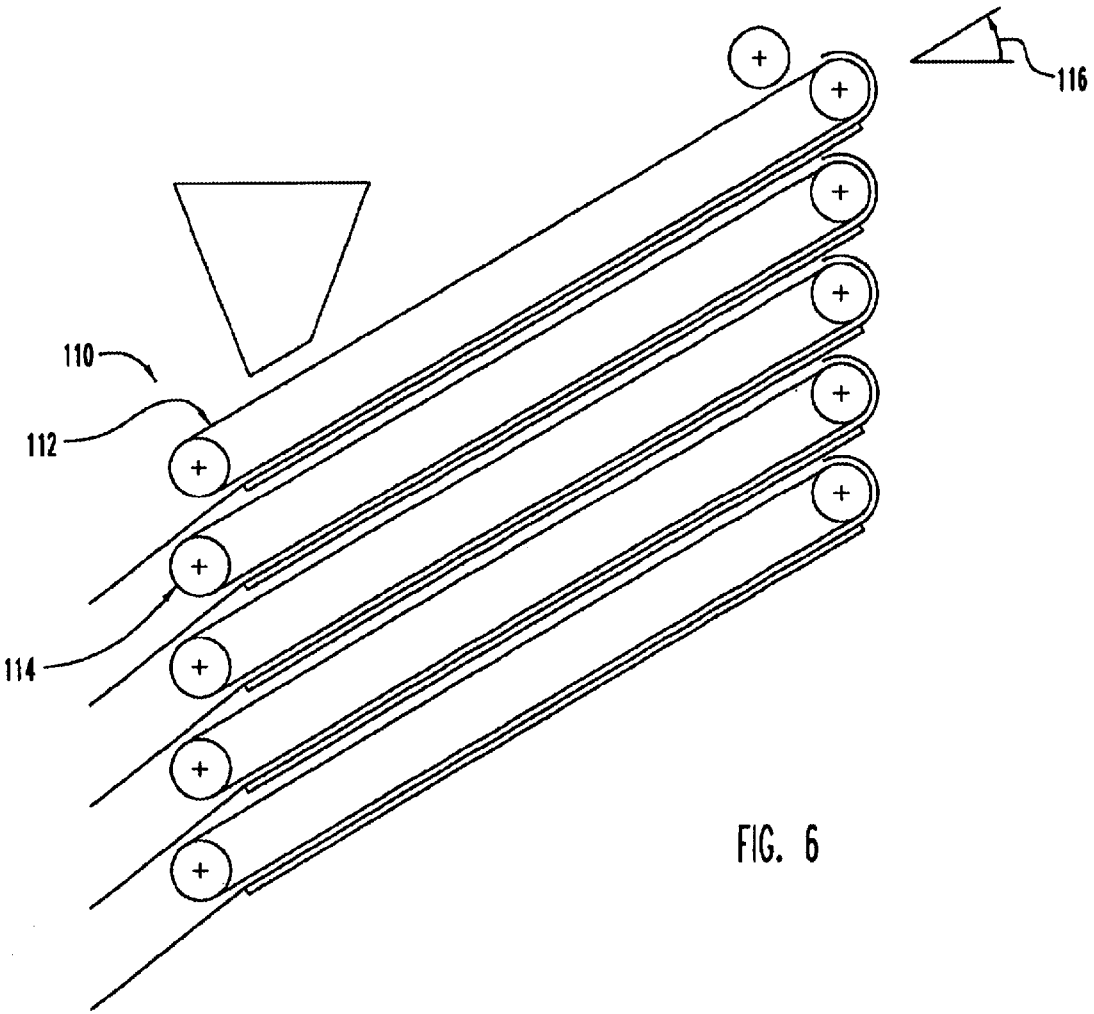
FIG. 6 is a front schematic view similar to FIG. 1 of a second embodiment coin sorter in accordance with the present invention.

FIG. 6 illustrates a second embodiment coin sorter 110. In coin sorter 10, the conveyor belts 40 drive the coins along the sorting plates. Friction between the coins and the plates requires a relatively large amount of power to drive the conveyors. The sorter 110 uses less power.

The coin sorter 110 includes a coin feed device 112 similar to the device 12 and a coin sorting device 114 similar to the device 14. The conveyor belts and sorting plates, however, are inclined generally at an angle 116 from the horizontal. The intake ends of the plates are above the discharge ends of the plates. This enables gravity to urge the coins downstream along the plates, lowering the power required to move the coins along the plates. The angle 116 is preferably between about 30 degrees and about 45 degrees.

Figure 7:
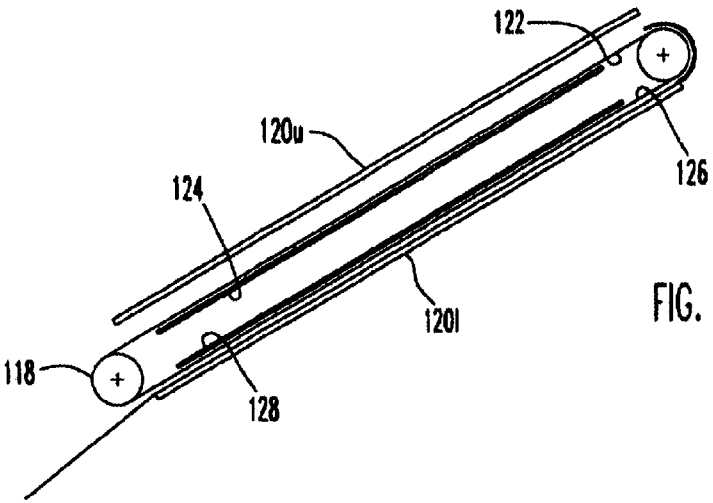
FIG. 7 is an enlarged view of a portion of the coin sorter shown in FIG. 6.

FIG. 7 illustrates a conveyor belt 118 located between an upper sorting plate 120*u* and a lower sorting plate 120*l*.

Beneath the upper belt run 122 is an upper support plate 124 and above the lower belt run 126 is a lower support plate 128. The support plates 124, 128 are closely spaced from the normal operating positions of the adjacent belt runs to support the conveyor belt against sagging during operation.

Figure 8:
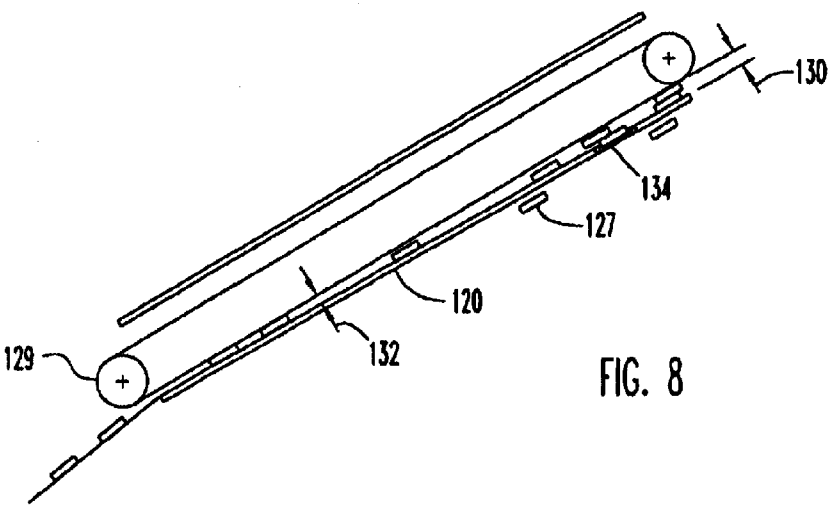
FIG. 8 is similar to FIG. 7 but showing operation of the coin sorter.

FIG. 8 illustrates operation of the coin sorting device 114. Coins 127 drop from the upper sorting plate 120*u* and fall on the upper belt run 122. The conveyor belt 118 is driven in the direction of arrow 129, and the upper belt run 122 travels uphill. Coins are held on the upper belt run by gravity and friction to move uphill with it. Preferably the outer surface of the conveyor belt has a roughened or pebbled texture to provide sufficient friction to prevent the coins from sliding downhill.

Each coin sorting plate 120 is not parallel with its associated lower belt run. As shown in FIG. 8, the sorting plate 120 is inclined to the horizontal at an angle somewhat less than the angle 116. The upper end of the sorting plate is spaced further away from the belt run than the lower end of the plate. This preferably forms an intake clearance 130 that is greater than twice the minimum thickness of the coins discharged onto the plate. The clearance between the sorting plate 120 and the lower belt run 126 decreases as the coins slide down the plate. Further downsteam the clearance 132 equals the minimum coin thickness.

Coins received at the intake end of the sorting plate 120 initially slide down the plate by gravity instead of being mechanically driven along the sorting plate as in apparatus 10. The force of gravity alone drives the coins down the plate and presses the coins against the plate. This reduces the energy required to drive the coins along the sorting plate.

If stacked coins are received at the intake end of the sorting plate, the bottom coins may successively fall through the holes 134 in the sorting plate. If the bottom coin is of the denomination associated with the sorting plate, the coin cannot fall through the plate. As the stacked coins slide down the plate the topmost coins will eventually contact the lower belt run and be stripped from the stack. Eventually, by the bottom coins falling through the plate or by the topmost coins being stripped by the lower belt run, a single layer of coins forms and slides down the plate.

The layer of coins eventually contacts the lower belt run 126. This contact occurs before coins gain sufficient speed to "fly" over the holes 134 and not fall through them. The lower belt run drives the coins at a controlled speed to prevent fly over until the coins reach the discharge end of the sorting plate.

In other embodiments the coins could contact a stationary surface or stripper wheel above the sorting plate rather than a moving belt. The surface or wheel would strip the topmost coins and regulate the downstream speed of the coins. In yet other embodiments the coins could slide by gravity alone the entire length of the sorting plate if the inclination angle and friction are such that coin fly over does not occur. In such embodiments the drive devices may, perhaps, not include any moving parts.

Figure 9:
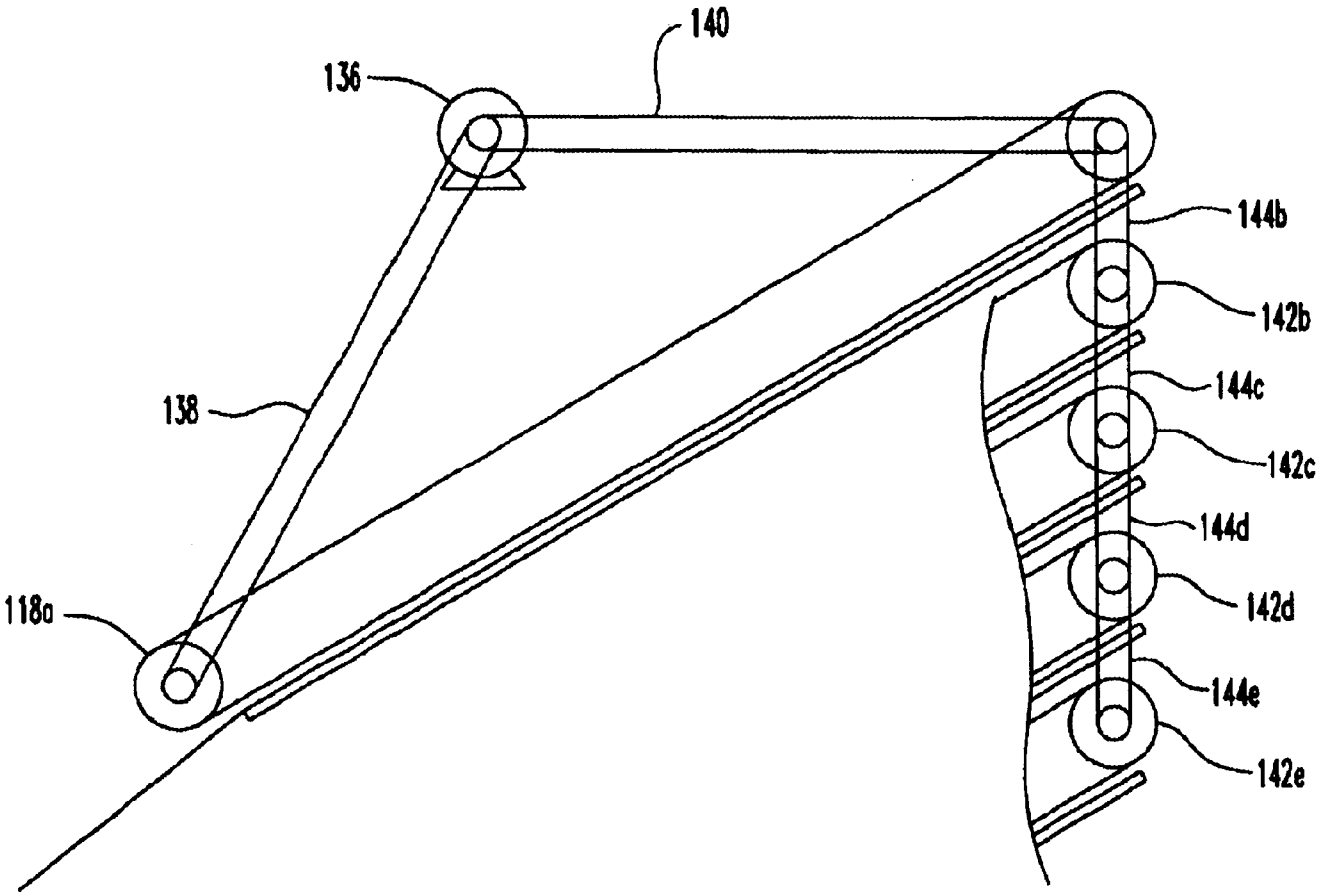
FIG. 9 is a partial schematic view of the drive system of the coin sorter shown in FIG. 6.

FIG. 9 illustrates the drive system used to power the conveyor belts 118. A motor 136 powers a pair of drive belts 138, 140, each drive belt 138, 140 connected to a respective roller of the uppermost conveyor belt 118*a*. The uppermost belt is the most heavily loaded belt and therefore both of its rollers are powered. Drive belts 144 extend between each pair of conveyors as shown to drive the other conveyors. Because of the relatively low power requirements, it is practical to power all the conveyor belts from the one motor 136.

The drive devices that drive the coins along the sorting plates include mounting structure that mount the conveyor belts and sorting plates at the desired inclination angle. The mounting structure enables the force of gravity urge the coins along the sorting plates as previously described.

Figure 11:
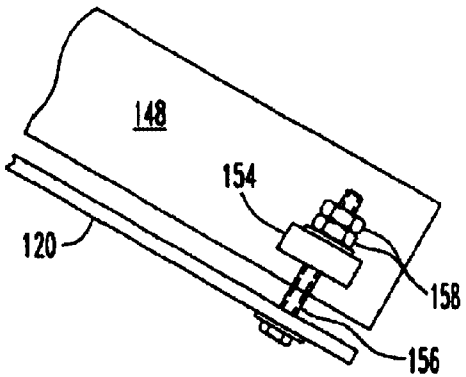
FIG. 11 is similar to FIG. 10 but is a closer view taken from the opposite side of the structure shown in FIG. 10.
Figure 10:
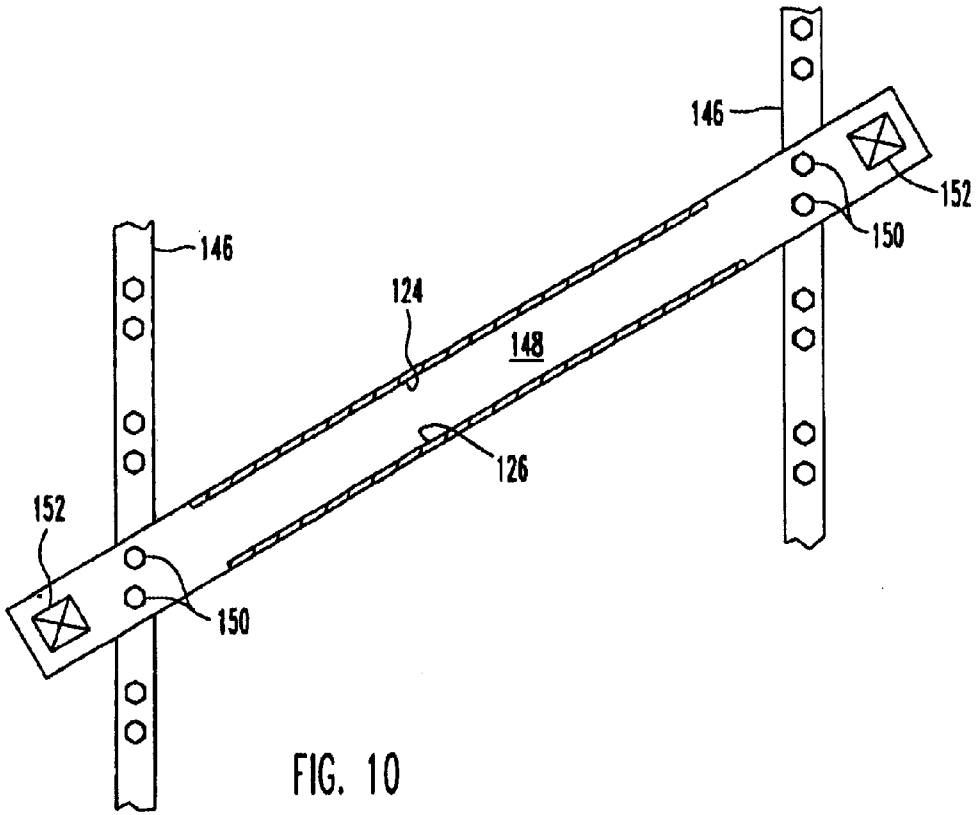
FIG. 10 is a partial side view of the mounting structure of the coin sorter shown in FIG. 6.

FIGS. 10 and 11 illustrate the structure mounting one side of the conveyor belts and supporting plates, it being understood a mirror image of the structure supports the other side of the belts and plates. A pair of spaced-apart vertical columns 146 extend from a base (not shown). A number of vertically spaced mounting plates 148 (only one of which is shown in the figures) extend between the columns at an angle defining the inclination angle 116 and are fastened to the columns by sets of bolts 150. The other sets of bolts represent mounting locations for other mounting plates. Ends of the upper and lower support plates 124, 126 are welded to the plate 148. A pair of bearing assemblies 152 are carried on the inner surface of the plate and journal the conveyor rollers.

Mounted on the outer plate surface are lugs 154 that carry the sorting plate 120 by bolts 156 and nuts 158. The bolts 156 extend through mounting holes in the sorting plate 120 that, in the illustrated embodiment, align the through holes 134 at the desired offset angle corresponding to the angle 72. The inclination of the sorting plate with respect to the conveyor belt can be individually adjusted for each sorting plate. Angle iron (not shown) or other side walls can extend downstream along the sides of the sorting plate to prevent coins from falling off the plate.

Figure 12:
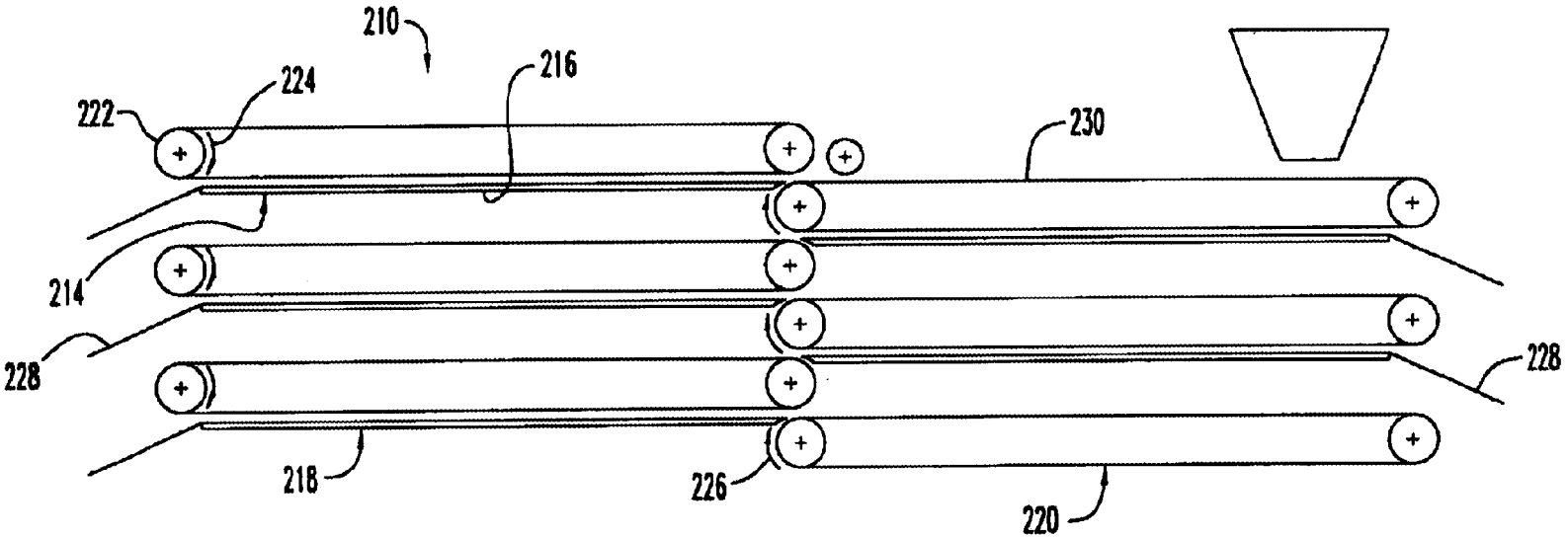
FIG. 12 is a front schematic view similar to FIG. 1 of a third embodiment coin sorter in accordance with the present invention.

FIG. 12 illustrates a third embodiment coin sorter 210 in accordance with the present invention. The apparatus 210 includes a feed device 212 and a coin sorting device 214. The sorting device 214 includes a number of horizontal sorting plates 216, similar to the sorting plates 24. In this embodiment each plate of the pairs of upper and lower sorting plates 216*u*, 216*l* are horizontally offset from each other to form left-hand and right-hand plate stacks 218 and 220 respectively. Conveyor belts 222 are located above respective sorting plates 216 to drive the coins along the plates. The conveyors above the left-hand plates are driven as indicated by arrow 224 and the conveyors above the right-hand plates are driven as indicated by arrow 226. The coins discharge from discharge chutes 228.

Coins fall through an upper sorting plate and drop onto the upper belt run of the next conveyor belt below. The belt run is substantially flush with the upper surface of the lower sorting plate. The upper belt run of one of the uppermost conveyors forms a portion of the feed device 212, similar to the belt run 54 of the apparatus 10.

Figure 13:
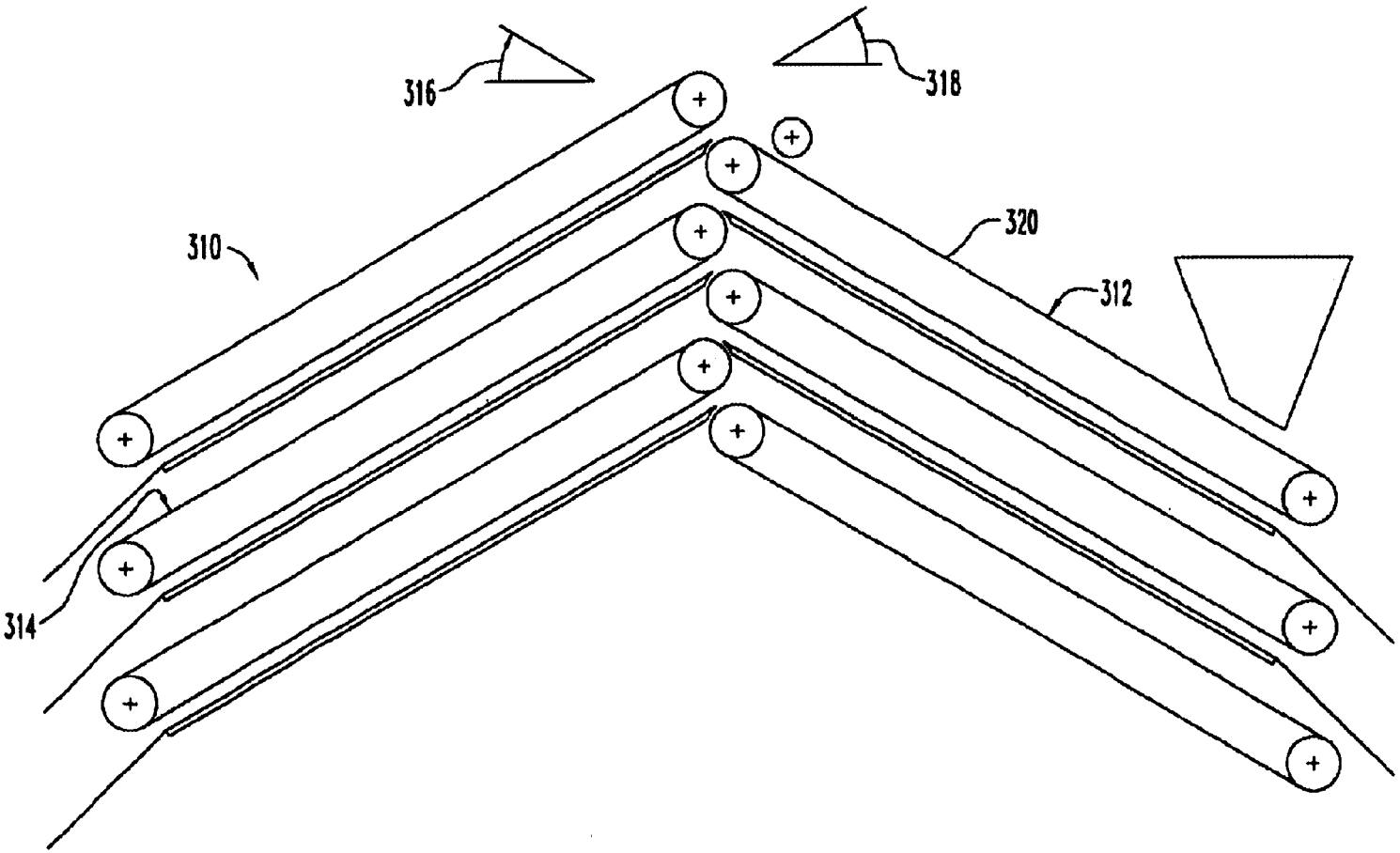
FIG. 13 is a front schematic view similar to FIG. 1 of a fourth embodiment coin sorter in accordance with the present invention.

FIG. 13 illustrates a fourth embodiment coin sorter 310 having a coin feed device 312 and coin sorting device 314. Apparatus 310 is similar to apparatus 210 except that the left-hand and right-hand stacks of conveyors and sorting plates are inclined at angles 316 and 318 respectively as shown. The coins can be urged by gravity along the plates as previously described for the apparatus 110.

Other embodiments of coin sorter in accordance with the present invention may include additional sorting plates to filter out contaminants or unwanted coinage at different points in the sorting stream. For example, if tokens, slugs, or foreign coins of a diameter intermediate of nickels and quarters were present in the unsorted coins, an additional sorting plate can be placed between the quarters and nickels plates. The additional sorting plate removes and discharge the tokens. Sorting of contaminants, tokens, foreign coins and the like from the coin stream is deemed equivalent to sorting and discharging coins of equivalent diameter or dimension.

Yet other embodiments of the coin sorter in accordance with the present invention may include feed devices other than those shown in the illustrated embodiments. For example, a feed device could include a number of rotating disks that each discharge a stream of coins to the coin sorting device.

While I have illustrated and described preferred embodiments of my invention, it is understood that these are capable of modification, and I therefore do not wish to be limited to the precise details set forth, but desire to avail myself of such changes and alterations as fall within the purview of the following claims.

What I claim as my invention is:

1. A coin sorter for sorting coins by denomination, each coin denomination having a respective coin diameter, the coin sorter comprising:

a coin feed device and a coin sorting device, the feed device configured to receive a plurality of coins of various denominations and feed the coins to the coin sorting device for sorting;

the coin sorting device comprising:

(a) a plurality of stationary sorting stations, each station associated with a respective coin diameter, each station having a thickness;

each sorting station comprising a surface for supporting coins on the station and a plurality of through-holes extending from the surface and through the station thickness and having a diameter related to the diameter of the coin associated with the station;

the sorting stations arranged in series from a first sorting station to a last sorting station, the first sorting station arranged to receive coins from the coin feed device, the remaining sorting stations each arranged to receive coins from the preceding sorting station, each sorting station but the last sorting station arranged to discharge coins to the next sorting station; and (b) a drive device, the drive device arranged to urge coins along the sorting stations and extending from the first sorting station to the last sorting station, the drive device operating to urge coins against the surface of each sorting station whereby coins having a diameter less than the diameter of the sorting station holes fall through the holes and are discharged from the coin sorting device while the remainder of the coins move to the succeeding sorting portion;

whereby each sorting portion discharges only those coins associated with such sorting portion to sort the coins by denomination.

2. The coin sorter of claim 1 wherein each sorting station is formed as a separate sorting plate.

3. The coin sorter of claims wherein the first sorting plate is associated with the largest coin diameter, and each succeeding sorting plate is associated with the next-smaller coin diameter;

the holes of each sorting plate have a diameter smaller than the coin diameter associated with the sorting plate but larger than the next-smaller coin diameter;

the drive device comprises a plurality of drive devices and one or more transfer devices;

each drive device is associated with a respective sorting plate to urge coins along the plate from the intake end to the discharge end; and each transfer device is disposed beneath a respective preceding sorting plate to receive coins that fall through the plate and transfer those coins to the intake end of the succeeding plate associated with such preceding plate;

whereby each sorting plate discharges only those coins associated with the sorting plate.

4. The coin sorter of claim 3 wherein each drive device comprises structure mounting its associated sorting plate at an angle inclined to the horizontal, the plate intake end above the plate discharge end whereby coins are urged by gravity to slide down the plate.

5. The coin sorter of claim 4 wherein each drive device comprises a coin engagement surface downstream from the intake end of the sorting plate associated with the drive device, the engagement surface spaced above and facing the plate to contact coins moving on the plate and thereby regulate the speed of the coins along the plate.

6. The coin sorter of claim 4 wherein each of the sorting plates has an intake clearance not less than twice the minimum coin thickness whereby stacked coins can be received onto the plate.

7. The coin sorter of claim 6 wherein each drive device includes a coin stripping surface above and facing the sorting plate associated with the drive device, the stripping surface spaced from the plate support surface a distance greater than the maximum coin thickness to strip stacked coins sliding on the plate.

8. The coin sorter of claim 4 wherein the drive devices mount the sorting plates at an angle of about 45 degrees or less from the horizontal.

9. The coin sorter of claim 3 wherein each drive device comprises a drive belt spaced above the sorting plate associated with the drive device to engage and drive coins along the plate.

10. The coin sorter of claim 3 wherein each transfer device comprises a conveyor to receive dropped coins and transport the dropped coins to the next plate.

11. The coin sorter of claim 10 wherein each conveyor is configured to transport coins a distance uphill.

12. The coin sorter of claim 3 wherein the sorting plates are vertically spaced from each other, the sorting plate associated with the largest coin diameter being the uppermost plate and each next lower sorting plate associated with the next smaller coin diameter whereby the sorting plates define respective pairs of upper and lower sorting plates.

13. The coin sorter of claim 12 wherein the sorting plates are arranged in a single vertical stack and at least partially overlie one another.

14. The coin sorter of claim 13 further comprising a plurality of endless conveyors, each conveyor located between a respective pair of upper and lower sorting plates and comprising an upper belt run facing the upper plate and a lower belt run facing the lower plate, the upper belt run forming a portion of the transfer device associated with the upper plate, the upper belt run configured to receive coins that fall through the upper plate for transport to the lower plate, and the lower belt run forming a portion of the drive device associated with the lower plate to engage and drive coins along the lower plate.

15. The coin sorter of claim 14 wherein each transfer device includes a guide surface extending between the upper belt and the lower belt run, the conveyor belt and the guide surface spaced apart and defining a coin channel therebetween to receive coins from the upper belt run and discharge the coins onto the lower support plate.

16. The coin sorter of claim 15 wherein the sorting plates and belt runs are inclined to the horizontal, the intake end of each plate being higher than the discharge end of the plane.

17. The coin sorter of claim 12 wherein each upper sorting plate is horizontally spaced from its associated lower sorting plate and does not overlie the lower sorting plate.

18. The coin sorter of claim 17 wherein the sorting plates and belt runs are inclined to the horizontal, the intake end of each plate being higher than the discharged end of the plate.

19. The coin sorter of claims 17 further comprising a plurality of conveyors, each conveyor located beneath a respective upper sorting plate and comprising an upper belt run facing the upper plate and forming portion of the transfer device associated with the upper plate, the upper belt run configured to receive coins that drop through the upper plate and discharge the coins at the intake end of the lower sorting plate associated with the upper plate.

20. The coin sorter of claim 19 wherein each conveyor but the conveyor beneath the lowermost conveyor comprises a lower belt run facing a respective plate, the lower belt run forming a portion of the drive device associated with the facing plate to engage and drive coins along such facing plate.

21. The coin sorter of claim 3 wherein each drive device is configured to translate coins along a first axis and the through-holes of the sorting plate are arranged downstream along the plate along a second axis not parallel with the first axis.

22. The coin sorter of claim 21 wherein the first and second axes are offset by about five degrees with respect to each other.

23. A method of sorting coins by denomination, each denomination having a respective coin diameter, the method comprising the steps of:

providing a plurality of coin sorting stations, each sorting station associated with a respective coin diameter, the sorting stations arranged in series from a first sorting station to a last sorting station, each sorting station comprising a surface and a plurality of through-holes extending from the surface through a thickness of the station, each hole having a diameter associated with the coin diameter associated with the station;

feeding a stream of unsorted coins onto the surface of the first sorting station;

driving the coins along the first sorting station wherein the coins are urged against the surface and first set of coins having a diameter larger than the holes of the sorting station stay on the station and a second set of coins having a diameter smaller than the holes of the sorting station fall through the holes, thereby sorting the first and second sets of coins from one another;

transporting one of the sets of coins to the next sorting station;

and repeating the steps of driving the coins along the sorting station and sorting first and second sets of coins from one another to sort the coins by denomination.

24. The method of claim wherein 23 the steps of driving the coins along the sorting stations each comprise the step of driving the coins by a non-gravity force.

25. The method of claim 23 wherein the steps of driving the coins along the sorting stations each comprise the step of driving the coins by the force of gravity.

26. The method of claim 25 wherein the steps of driving the coins along the sorting stations by gravity each comprise the step of applying a force resisting acceleration of the coins by gravity to thereby regulate the maximum speed of the coins along the station.

27. The method of claim 23 wherein the steps of driving the coins along the sorting station each include the step of stripping stacked coins prior to or during the movement of the coins along the station.

28. The method of claim 23 wherein the first sorting station is associated with the largest coin diameter, and each succeeding sorting station is associated with the next-smaller coin diameter;

the holes of each sorting plate have a diameter smaller than the coin diameter associated with the sorting plate but larger than the next-smaller coin diameter; and the step of transporting one of the sets of coins comprises the step of transporting the second set of coins to the next sorting station.

* * * * *